US008172337B2

(12) United States Patent
Kwon et al.

(10) Patent No.: US 8,172,337 B2
(45) Date of Patent: May 8, 2012

(54) TOOTHBRUSH HAVING NEEDLE-SHAPED BRISTLES WITH VARIOUS END POINTS AND MANUFACTURING METHOD THEREOF

(75) Inventors: Young-Jun Kwon, Gyunggi-do (KR); Sung-Wook Kwon, Seoul (KR); Sung-Hwan Kwon, Seoul (KR)

(73) Assignee: Best Whasung Co., Ltd., Paju, Gyunggi-do (KR)

( * ) Notice: Subject to any disclaimer, the term of this patent is extended or adjusted under 35 U.S.C. 154(b) by 783 days.

(21) Appl. No.: 10/548,636

(22) PCT Filed: May 14, 2003

(86) PCT No.: PCT/KR03/00952

§ 371 (c)(1),
(2), (4) Date: Aug. 21, 2006

(87) PCT Pub. No.: WO2004/080237

PCT Pub. Date: Sep. 23, 2004

(65) Prior Publication Data

US 2007/0033756 A1 Feb. 15, 2007

(30) Foreign Application Priority Data

Mar. 12, 2003 (KR) ..... 10-2003-0015480

(51) Int. Cl.
*A46B 9/04* (2006.01)

(52) U.S. Cl. ..... 300/21

(58) Field of Classification Search ..... 15/167.1, 15/207.2; 300/21

See application file for complete search history.

(56) References Cited

U.S. PATENT DOCUMENTS

| | | | | |
|---|---|---|---|---|
| 5,500,975 | A | 3/1996 | Sano | |
| 5,533,227 | A * | 7/1996 | Ito et al. | 15/167.1 |
| 6,088,869 | A | 7/2000 | Kaneda et al. | |
| 6,090,488 | A | 7/2000 | Kweon | |

FOREIGN PATENT DOCUMENTS

| | | | |
|---|---|---|---|
| CN | 1218375 | A | 6/1999 |
| CN | 1371645 | A | 10/2002 |
| JP | 49-47618 | | 5/1974 |
| JP | 5-15834 | | 3/1993 |
| JP | 19930015834 | A | 1/1994 |
| JP | 7-284412 | | 10/1995 |
| JP | 19950284412 | A | 8/1996 |
| JP | 1997299148 | A | 5/1998 |
| JP | 19990290134 | B1 | 1/2005 |
| KR | 20-0308084 | | 3/2003 |

* cited by examiner

*Primary Examiner* — Laura C Guidotti

(74) *Attorney, Agent, or Firm* — Lowe Hauptman Ham & Berner LLP

(57) ABSTRACT

A toothbrush having needle-shaped bristles with various end points and a method of manufacturing the same. The needle-shaped toothbrush bristle, folded in an asymmetric U-shape to outwardly expose both ends thereof at a height difference ranging from 0.5 to 2 mm and disposed on a head portion of the toothbrush, has a tapered length of 3-7 mm and a blunt end point with a diameter of 0.01-0.07 mm. The toothbrush is advantageous in terms of high insertion function into the periodontal pockets of the user while leaving the user with a refreshed feeling after brushing his/her teeth.

5 Claims, 1 Drawing Sheet

TOOTHBRUSH HAVING NEEDLE-SHAPED BRISTLES WITH VARIOUS END POINTS AND MANUFACTURING METHOD THEREOF

TECHNICAL FIELD

The present invention pertains, in general, to toothbrushes having needle-shaped bristles with various end points and manufacturing methods thereof. More specifically, the present invention is directed to a toothbrush having needle-shaped bristles each having a blunt end point with a diameter of 0.01-0.07 mm, and a method of manufacturing the same.

BACKGROUND ART

As well known to those skilled in the art, the so called needle-shaped toothbrush bristles having tapered ends have been widely used in recent years, because of easier removal of impurities between the teeth or the tooth and the gum of the user with excellent scaling function, compared to conventional toothbrush bristles.

Such needle-shaped bristles may be manufactured by mechanically grinding the ends of toothbrush bristles. But, this process is disadvantageous in light of high manufacturing cost. As well, the above toothbrush bristles have shortly tapered lengths and needle-shaped ends, and thus the bristles may injure the gum of the user. Hence, the toothbrush bristles obtained by the above-mentioned process are unsuitable for use in toothbrushes.

Alternatively, there are developed methods of tapering the ends of toothbrush bristles by suitably dissolving the ends of the toothbrush bristles in a chemicals, such as an acid or alkali, to have a sufficiently tapered length, and such a method is representatively exemplified by Korean Patent No. 130932 invented by the present inventors.

The method disclosed in Korean Patent No. 130932 comprises the steps of (i) cutting a toothbrush bristle made of PBT or PET to a desired length, (ii) vertically immersing an end of the cut toothbrush bristle to a depth of 8-9 mm in 60-98% suliric acid solution at 80-200° C. so as to taper it, followed by treating the other end of the toothbrush bristle in the same manner as in this step, (iii) cooling the tapered toothbrush bristle in cooling water, (iv) neutralizing the cooled toothbrush bristle with 30-70% caustic soda or potassium hydroxide solution, and (v) washing the neutralized toothbrush bristle with water and drying it.

Thusly obtained toothbrush bristles have needle-shaped sharp ends each having a tapered length of 4-8 mm and a tip with a diameter of 0.01-0.02 mm as shown in FIG. 1. Such toothbrush bristles are referred to as "highly tapered toothbrush bristles".

Although the highly tapered toothbrush bristles have the sharp ends as in a needle, the bristles have a long tapered length and are soft, and do not injure the gum of the user. Further, when the above toothbrush bristles are used, scaling function between the teeth or in the periodontal pockets may be easily performed.

However, the highly tapered toothbrush bristles have the following drawbacks.

First, even under the fixed conditions of concentration, temperature and immersion time of the used chemicals, it is difficult to manufacture the toothbrush bristles having regularly tapered lengths and end points each with a uniform diameter, depending on the immersion position and the immersed bristle number.

Second, when the toothbrush bristles are excessively dissolved, the bristles have a shorter length than a desired length.

In contrast, the toothbrush bristles may also be undesirably long, therefore resulting in increased defective rates.

Third, too-soft toothbrush bristles result in unsatisfactory feeling after using the toothbrush, according to the users.

Fourth, the toothbrush bristles have very short service life and are expensive.

Therefore, with the aim of solving the above problems, there are proposed conventional techniques, for example, Korean Utility Model No. 114700 and Korean Patent No. 261658 by the present inventors.

In Korean Utility Model No. 114700, an end of a toothbrush bristle is tapered up to ¼ of its length from a terminal point of the bristle (eg., 8 mm when a toothbrush bristle is 32 mm long), and the other end thereof is tapered up to ⅛ of its length from the other terminal point (4 mm when a toothbrush bristle is 32 mm long), thereby obtaining the toothbrush bristle having differently tapered ends (8 mm, 4 mm), which is then disposed on a toothbrush. Therefore, this toothbrush has a certain extent of hardness, in addition to a scaling function and a plaque-removing function.

Additionally, in Korean Patent No. 261658, a toothbrush bristle made of PBT has both end points each with a diameter of 0.04-0.08 mm, provided that it is manufactured by the same method as in Korean Patent No. 130932. The above patent is advantageous in light of low manufacturing cost of the tapered toothbrush bristle, because of using a physical tapering method and a chemical tapering method together. Thusly obtained toothbrush is used by persons adapted to conventional toothbrushes formed of stiff nylon bristles, but it is ineffective for removing impurities between the periodontal pockets due to end points each with a relatively large diameter.

The toothbrush bristles having the above properties are applied to production of respective toothbrush products. However, the toothbrush having all properties mentioned above has not been produced yet. Further, in the above techniques, it is difficult to manufacture the toothbrush bristle having a desirable tapered length and an end point with a desired diameter, thus increasing defective rates. Attributable to these problems, all conventional toothbrush products suffer from excessive manufacturing cost.

DISCLOSURE OF THE INVENTION

Therefore, it is an object of the present invention to alleviate the problems in the prior art and to provide a method of manufacturing a needle-shaped toothbrush bristle, which is advantageous in terms of simple manufacturing process and low defective rates.

It is another object of the present invention to provide a toothbrush having needle-shaped bristles, which is long in service life.

It is a further object of the present invention to provide a toothbrush having needle-shaped bristles, capable of inserting into the periodontal pockets of the user and allowing the user to feel refreshed after brushing his/her teeth.

To achieve the above objects, there is provided a toothbrush comprising needle-shaped bristles each having a tapered length of 3-7 mm and an end point with a diameter of 0.01-0.07 mm, folded in an asymmetric U-shape to outwardly expose both ends thereof at a height difference ranging from 0.5 to 2 mm and disposed on a head portion of the toothbrush.

In addition, there is provided a method of manufacturing a toothbrush, comprising the following steps of: immersing each of cut filaments for use in toothbrush bristles to a depth of 7 mm in an alkaline or acidic solution, to prepare needle-shaped bristles each having both tapered ends having tapered lengths of 3-7 mm and various end points each with a diameter of 0.01-0.07 mm; folding each of the needle-shaped bristles in an asymmetric U-shape to outwardly expose both ends thereof at a height difference ranging from 0.5 to 2 mm; and disposing each of the folded bristles on a head portion of the toothbrush.

BEST MODE FOR CARRYING OUT THE INVENTION

Figure 1:
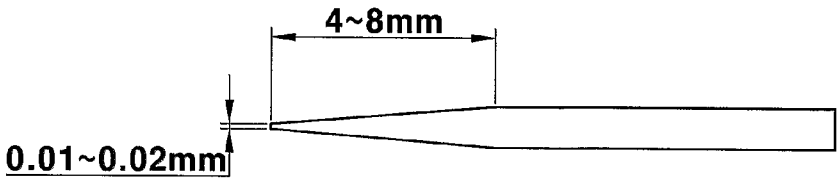
Fig. 1 Prior Art
FIG. 1 is a schematic view showing a highly tapered needle-shaped bristle according to conventional techniques.
Figure 2:
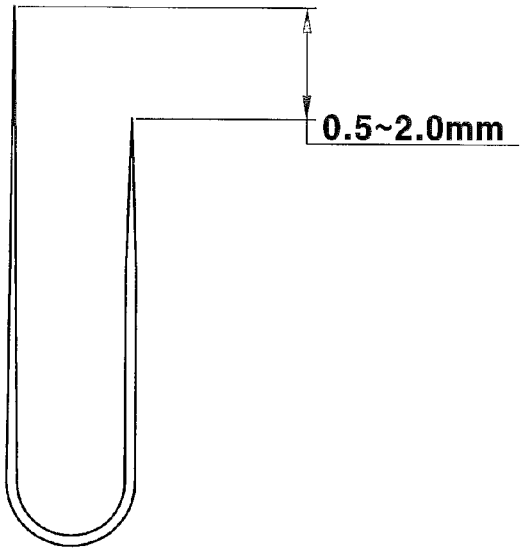
FIG. 2 is a schematic view showing a needle-shaped toothbrush bristle folded asymmetrically according to the present invention.
Figure 3:
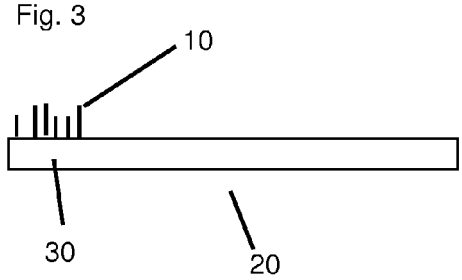
FIG. 3 is a side elevational view of a tooth brush having the bristles of FIG. 2 thereon.

With reference to FIG. 3, there is shown a toothbrush 20 of the present invention comprising a plurality of needle-shaped bristles, in which the bristles 10 each having both tapered ends each with a tapered length of 3-7 mm and a blunt end point with a diameter of 0.01-0.07 mm is disposed on a head portion 30 of the toothbrush 10. As can be seen in FIG. 2, the bristles 10 are folded in an asymmetric U-shape to outwardly expose both ends thereof at different heights, wherein the height difference between respective ends of each bristle is 0.5-2 mm.

Respective needle-shaped bristles 10 for use in the toothbrush 20 of the present invention have tapered lengths of 3-7 mm. If the length is less than 3 mm, the gum of the user suffers injury due to excessive stiffness of the toothbrush bristle upon brushing his/her teeth. Meanwhile, if the length exceeds 7 mm, the user feels unsatisfactory results after brushing his/her teeth due to low stiffness of the toothbrush bristle 10.

In the present invention, each of the needle-shaped bristles 10 has both blunt end points each with a diameter of 0.01-0.07 mm, and preferably, 0.01-0.04 mm.

A relatively larger diameter of the end point results in providing stiffness and softness to the toothbrush 20 at the same time. As well, the toothbrush bristle 10 of the present invention functions to remove impurities in the periodontal pockets with scaling function, similarly to those of conventionally used highly tapered toothbrush bristles. In particular, the needle-shaped toothbrush bristle 10 having blunt end points each with a large diameter is easy to manufacture, and has low defective rates. When the diameter of the end point falls out of the above range, an insertion function of the toothbrush 20 into the periodontal pockets of the user is decreased.

The needle-shaped toothbrush bristle is made of a polyester resin, such as PBT or PET. The polyester resin is stiffer than nylon used generally as the toothbrush bristle, and also has bending resistance. Thus, since the gum of the user may suffer injury upon use of the toothbrush formed of such a resin, the resin is needle-shaped to suitably control stiffness. In addition, the polyester resin is advantageous in terms of lower water absorption and lower price, compared to nylon resin.

Although conventional toothbrush bristles are symmetrically folded and used, the needle-shaped toothbrush bristle is folded in an asymmetric U-shape to outwardly expose both ends thereof at different heights, wherein the height difference between respective ends of each bristle is 0.5-2 mm. Compared to conventional toothbrushes having needle-shaped bristles folded symmetrically, the inventive toothbrush having needle-shaped bristles folded asymmetrically is advantageous in that respective bristles can be easily inserted into the teeth or the periodontal pockets of the user.

When the height difference of the folded bristle is less than the above lower limit, the above-mentioned functions are not exhibited. Meanwhile, if the height difference exceeds the upper limit, the user feels unsatisfactory upon brushing his/her teeth.

As for a method of manufacturing the toothbrush of the present invention, each of filaments for use in toothbrush bristles cut to a suitable length is vertically immersed to a depth of 7 mm in an alkaline or acidic solution to be tapered at both ends thereof, thereby obtaining a plurality of needle-shaped toothbrush bristles respectively having both tapered ends each with a tapered length of 3-7 mm and a blunt end point with a diameter of 0.01-0.07 mm.

When each of the filaments for use in toothbrush bristles having the same diameter between 0.15 and 0.20 mm is immersed in the solution, an immersed end thereof begins to dissolve and to be 0.01 mm across. However, a plurality of the toothbrush bristles are bundled by use of a cylindrical film or paper having a diameter of 40-60 mm and then immersed in the solution. Thus, respective bristles in each bundle are differently dissolved and have various end points each with a different diameter. The toothbrush bristles having end points each with a specifically limited diameter are difficult to manufacture, thereby increasing the defective rates. In the present invention, the needle-shaped bristle having both end points each with a diameter of 0.01-0.07 mm, and preferably 0.01-0.04 mm is manufactured and disposed on a head portion of the toothbrush without performing a post-treatment process, such as grinding process. Therefore, a manufacturing cost of the toothbrush is decreased and defective rates become very low.

In order to obtain the uniformly tapered needle-shaped bristles having various end points each with a diameter of 0.01-0.07 mm, although the filaments for use in toothbrush bristles having the same diameter are used, the filaments for use in toothbrush bristles having different diameters may be bundled and immersed in the solution.

Further, each of the needle-shaped toothbrush bristles is not symmetrically but asymmetrically folded to outwardly expose both ends thereof at a height difference ranging from 0.5 to 2 mm, and then disposed on the toothbrush. The toothbrush having bristles folded at different heights is advantageous in terms of excellent insertion function into the periodontal pockets and high workability.

A better understanding of the present invention may be obtained through the following examples, which are set forth to illustrate, but are not to be construed as the limit of the present invention.

EXAMPLE 1

After 80% sulfuric acid was charged at a height of 6 mm in 1000 ml beaker, the beaker was placed in a sand bath and heated to 120° C. A bundle of bristle filaments (diameter 50 mm), each of which is made of PBT (520) having a diameter of 0.203 mm purchased from Toray Co. Ltd., Japan, were cut to a length of 31 mm. One end portion of the bundle was immersed in a sulfuric acid solution.

After 10 min, several bristle filaments in the bristle bundle were randomly picked by tweezers every 2 min, and observed by a microscope. After 18 min, a diameter of an end point of the bristle filament was confirmed to be 0.07 mm. The bristle bundle was let to stand for a further 1 min, after which it was removed from the solution and the other end side thereof was tapered as mentioned above.

The bristle bundle having tapered end portions was neutralized with 30% caustic soda solution, washed with water, and dried, to obtain needle-shaped bristles tapered at both sides. As such, each of the needle-shaped bristles had a blunt end point with a diameter of 0.01-0.07 mm, and a tapered length of 6 mm.

Such a toothbrush bristle was folded in an asymmetric U-shape to outwardly expose both ends thereof at a height difference of 1 mm, and disposed on a head portion of the toothbrush, to manufacture a toothbrush of the present invention. The inventive toothbrush has similar insertion function and a more refreshed feeling after using it, compared to those of conventional toothbrushes having highly tapered needle-shaped bristles (end point with a diameter 0.01-0.02 mm, tapered length 7 mm).

EXAMPLE 2

Respective needle-shaped toothbrush bristles were manufactured in the same manner as in the above example 1, except that filaments for use in toothbrush bristles having different diameters of 0.152, 0.178, 0.203 mm were bundled. The manufactured needle-shaped bristles had blunt end points each with a diameter of 0.01-0.07 mm as in the above example 1, but were further uniformly distributed. The tapered length was in the range of 3-6 mm.

Such needle-shaped bristles were disposed on a head portion of a toothbrush as in the above example 1, to obtain the toothbrush of the present invention, which is excellent in insertion function into the periodontal pockets while leaving the user with a more refreshed feeling after using such a toothbrush, compared to conventional toothbrushes having highly tapered needle-shaped bristles.

EXAMPLE 3

Respective needle-shaped toothbrush bristles were prepared in the same manner as in the above example 2, except that an immersing process was performed until the diameter of the end point of the bristle filament was confirmed to be 0.04 mm, after which such bristles were let to stand for an additional 1 min. Thusly obtained needle-shaped bristles comprise 98% or more of end points each with a diameter of 0.01-0.04 mm. The toothbrush having the above needle-shaped bristles is excellent in insertion function into the periodontal pockets while leaving the user with a better refreshed feeling after using such a toothbrush, compared to conventional toothbrushes having highly tapered needle-shaped bristles.

Industrial Applicability

As described above, the present invention provides a toothbrush comprising needle-shaped bristles having differently tapered lengths and various end points each with a different diameter, asymmetrically folded and disposed on a head portion of the toothbrush, and a method of manufacturing the same. Such a toothbrush is excellent in insertion function into the periodontal pockets while leaving the user with a more refreshed feeling after using it. In addition, the inventive method of manufacturing the toothbrush is advantageous in terms of very simple manufacturing process, low defective rates, and low manufacturing cost. Further, a service life of the toothbrush bristle can be lengthened.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

The invention claimed is:

1. A method of manufacturing a toothbrush having a head portion, the method comprising:

cutting filaments so as to form bristles;

immersing first ends of the bristles in an alkaline or acidic solution until the first ends of the bristles have a length of tapering between 3 and 7 millimeters and respective chemically shaped blunt end points have various diameters of between 0.01 and 0.07 millimeters;

immersing second ends of the bristles in an alkaline or acidic solution until the second ends of the bristles have a length of tapering between 3 and 7 millimeters and respective chemically shaped blunt end points have various diameters of between 0.01 and 0.07 millimeters;

folding each of the bristles into an asymmetric U-shape such that said first end has a height difference with respect to said second end, the height difference being between 0.5 and 2 millimeters; and disposing each of the folded bristles on the head portion of the toothbrush.

2. The method of claim 1, said cut filaments having various diameters away from the first and second ends of between 0.15 and 0.20 millimeters.

3. The method of claim 2, wherein said filaments are formed of a polymeric material.

4. The method of claim 1, wherein said immersing is performed until the first ends of the bristles have the respective chemically shaped blunt end points with various diameters of between 0.01 and 0.04 millimeters; and the second ends of the bristles have the respective chemically shaped blunt end points with various diameters of between 0.01 and 0.04 millimeters.

5. The method of claim 1, wherein the bristles after said immersing are disposed in the head portion of the toothbrush without being mechanically ground.

* * * * *